US008277172B2

(12) United States Patent
Tesh et al.

(10) Patent No.: US 8,277,172 B2
(45) Date of Patent: Oct. 2, 2012

(54) APPARATUS FOR TURBINE ENGINE COOLING AIR MANAGEMENT

(75) Inventors: Stephen William Tesh, Simpsonville, SC (US); John Ernest Tourigny, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 708 days.

(21) Appl. No.: 12/409,160

(22) Filed: Mar. 23, 2009

(65) Prior Publication Data

US 2010/0239413 A1 Sep. 23, 2010

(51) Int. Cl.
*F01D 25/12* (2006.01)

(52) U.S. Cl. ..... 415/115

(58) Field of Classification Search ..... 415/115, 415/116, 112, 173.2, 173.7, 199.2, 128, 231; 277/609, 303

See application file for complete search history.

(56) References Cited

U.S. PATENT DOCUMENTS 2,970,808 A * 2/1961 Coppa ..... 416/190
3,982,850 A * 9/1976 Jenkinson ..... 415/178
4,436,311 A 3/1984 Brandon
4,472,939 A * 9/1984 Wang ..... 60/527
4,869,640 A 9/1989 Schwarz et al.
5,029,876 A 7/1991 Orlando et al.
5,094,551 A 3/1992 Kitamura et al.
5,203,673 A 4/1993 Evans
5,429,478 A 7/1995 Krizan et al.
5,503,528 A 4/1996 Glezer et al.
5,797,723 A * 8/1998 Frost et al. ..... 415/174.2
5,967,745 A 10/1999 Tomita et al.
6,065,934 A 5/2000 Jacot et al.
6,077,034 A 6/2000 Tomita et al.
6,152,690 A 11/2000 Tomita et al.
6,250,640 B1 6/2001 Wolfe et al.
6,257,586 B1 7/2001 Skinner et al.
6,331,006 B1 12/2001 Baily et al.
6,394,459 B1 5/2002 Florin
6,427,712 B1 8/2002 Ashurst
6,435,513 B2 8/2002 Skinner et al.
6,506,016 B1 1/2003 Wang
6,623,238 B2 * 9/2003 Langston et al. ..... 415/112
6,644,667 B2 11/2003 Grondahl
6,669,443 B2 12/2003 Burnett et al.
6,699,015 B2 3/2004 Villhard
6,786,487 B2 9/2004 Dinc et al.
6,811,375 B2 11/2004 Brisson et al.
7,052,017 B2 5/2006 Uchida et al.
7,059,829 B2 6/2006 Garner
7,367,776 B2 5/2008 Albers et al.
7,371,044 B2 5/2008 Nereim
7,448,849 B1 * 11/2008 Webster et al. ..... 415/173.1
7,520,718 B2 4/2009 Engle
7,641,200 B2 1/2010 Chevrette (Continued)

*Primary Examiner* — Alexander Gilman
(74) *Attorney, Agent, or Firm* — Cantor Colburn LLP

(57) ABSTRACT

An exemplary embodiment of the invention is directed to a turbine engine having a first, rotatable turbine rotor assembly, a second, stationary nozzle assembly disposed adjacent thereto and a wheel space which is defined between the first, rotatable turbine rotor assembly and the second, stationary nozzle assembly. The wheel space is operable to receive cooling air therein and includes a sealing feature located on the first rotatable turbine rotor assembly that extends axially into the wheel space to terminate adjacent to a sealing land positioned on the second, stationary nozzle assembly. The sealing feature and the sealing land operate to control the release of cooling air from within the wheel space and the sealing land is constructed of shape memory alloy.

12 Claims, 3 Drawing Sheets

U.S. PATENT DOCUMENTS

| | | | | |
|---|---|---|---|---|
| 7,655,001 | B2 | 2/2010 | Petrakis | |
| 7,686,569 | B2 | 3/2010 | Paprotna et al. | |
| 7,744,092 | B2 * | 6/2010 | Mortzheim | 277/303 |
| 7,946,808 | B2 | 5/2011 | Taylor et al. | |
| 7,967,558 | B2 | 6/2011 | Scricca | |
| 7,967,559 | B2 | 6/2011 | Bunker | |
| 7,976,026 | B2 | 7/2011 | Verma et al. | |
| 8,016,552 | B2 | 9/2011 | Bunker | |
| 8,066,473 | B1 * | 11/2011 | Aho, Jr. | 415/112 |
| 2001/0006278 | A1 | 7/2001 | Haje | |
| 2002/0130469 | A1 | 9/2002 | Kono | |
| 2002/0190474 | A1 | 12/2002 | Turnquist et al. | |
| 2003/0102630 | A1 | 6/2003 | Dinc et al. | |
| 2003/0156942 | A1 | 8/2003 | Villhard | |
| 2003/0185669 | A1 | 10/2003 | Brauer et al. | |
| 2004/0018082 | A1 | 1/2004 | Soechting et al. | |
| 2004/0150165 | A1 | 8/2004 | Grondahl | |
| 2004/0211177 | A1 | 10/2004 | Kutlucinar | |
| 2005/0058539 | A1 | 3/2005 | Diakunchak | |
| 2007/0243061 | A1 * | 10/2007 | Taylor et al. | 415/173.7 |
| 2008/0079222 | A1 | 4/2008 | Namuduri et al. | |
| 2008/0145208 | A1 | 6/2008 | Klasing et al. | |
| 2008/0265514 | A1 | 10/2008 | Mortzheim | |
| 2008/0267770 | A1 | 10/2008 | Webster et al. | |
| 2009/0043288 | A1 | 2/2009 | Petrakis | |
| 2009/0129917 | A1 * | 5/2009 | Hazevis et al. | 415/173.1 |
| 2009/0185896 | A1 * | 7/2009 | Kizuka et al. | 415/115 |
| 2009/0196738 | A1 | 8/2009 | Kizuka et al. | |
| 2009/0196742 | A1 | 8/2009 | Turnquist et al. | |
| 2009/0309311 | A1 | 12/2009 | Verma et al. | |
| 2010/0006303 | A1 | 1/2010 | Garcia et al. | |
| 2010/0102518 | A1 | 4/2010 | Gao et al. | |
| 2010/0183426 | A1 | 7/2010 | Liang | |
| 2010/0232938 | A1 | 9/2010 | Harris et al. | |
| 2010/0232939 | A1 | 9/2010 | Piersall et al. | |
| 2010/0239413 | A1 | 9/2010 | Tesh et al. | |
| 2010/0239414 | A1 | 9/2010 | Tesh et al. | |
| 2010/0254806 | A1 | 10/2010 | Deodhar et al. | |
| 2011/0182719 | A1 | 7/2011 | Deo et al. | |
| 2011/0187054 | A1 | 8/2011 | Namuduri et al. | |
| 2011/0189003 | A1 * | 8/2011 | Iida | 415/199.2 |

* cited by examiner

APPARATUS FOR TURBINE ENGINE COOLING AIR MANAGEMENT

BACKGROUND OF THE INVENTION

The subject matter disclosed herein relates to gas turbine engines and, more particularly, to temperature and performance management therein.

In a gas turbine engine, air is pressurized in a compressor and mixed with fuel in a combustor for generating hot combustion gas that flows downstream through one or more turbine stages. A turbine stage includes a stationary nozzle having stator vanes that guide the combustion gas through a downstream row of turbine rotor blades. The blades extend radially outwardly from a supporting rotor that is powered by extracting energy from the gas.

A first stage turbine nozzle receives hot combustion gas from the combustor and directs it to the first stage turbine rotor blades for extraction of energy therefrom. A second stage turbine nozzle may be disposed downstream from the first stage turbine rotor blades, and is followed by a row of second stage turbine rotor blades that extract additional energy from the combustion gas. Additional stages of turbine nozzles and turbine rotor blades may be disposed downstream from the second stage turbine rotor blades.

As energy is extracted from the combustion gas, the temperature of the gas is correspondingly reduced. However, since the gas temperature is relatively high, the turbine stages are typically cooled by a coolant such as compressed air diverted from the compressor through the hollow vane and blade airfoils for cooling various internal components of the turbine. Since the cooling air is diverted from use by the combustor, the amount of extracted cooling air has a direct influence on the overall efficiency of the engine. It is therefore desired to improve the efficiency with which the cooling air is utilized to improve the overall efficiency of the turbine engine.

The quantity of cooling air required is dependant not only on the temperature of the combustion gas but on the integrity of the various seals which are disposed between rotating and stationary components of the turbine. Thermal expansion and contraction of the rotor and blades may vary from the thermal expansion of the stationary nozzles and the turbine housing thereby challenging the integrity of the seals. In some cases the seals may be compromised causing excess cooling air to pass into the turbine mainstream gas flow resulting in excess diversion of compressor air translating directly to lower than desired turbine efficiency.

It is therefore desired to provide a gas turbine engine having improved sealing of gas turbine stationary to rotating component interfaces.

BRIEF DESCRIPTION OF THE INVENTION

In an exemplary embodiment of the invention a turbine engine comprises a first, rotatable turbine rotor assembly, a second, stationary nozzle assembly disposed adjacent thereto and a wheel space which is defined between the first, rotatable turbine rotor assembly and the second, stationary nozzle assembly. The wheel space is configured to receive cooling air therein and includes a sealing feature located on the first rotatable turbine rotor assembly that extends axially into the wheel space to terminate adjacent to a sealing land positioned on the second, stationary nozzle assembly. The sealing feature and the sealing land operate to control the release of cooling air from within the wheel space and the sealing land is constructed of shape memory alloy.

In another embodiment of the invention a turbine engine comprises a first, rotatable turbine rotor assembly, a second, stationary nozzle assembly disposed adjacent thereto and a wheel space defined between the first, rotatable turbine rotor assembly and the second, stationary nozzle assembly and configured to receive cooling air therein. A sealing feature located on the first, rotatable turbine rotor assembly extends axially into the wheel space to terminate adjacent to a sealing land positioned on the second, stationary nozzle assembly. The sealing feature and the sealing land operate to control the release of the cooling air from within the wheel space; the sealing land constructed of shape memory alloy.

In another embodiment, a turbine engine comprises a turbine housing having an upstream and a downstream end. A stationary nozzle assembly is disposed within the housing in fixed relationship thereto. A turbine rotor assembly is supported within the housing for rotation therein and is operable, during operation of the turbine engine, to thermally expand in the downstream direction relative to the stationary nozzle assembly. A wheel space, defined between the stationary nozzle assembly and the rotatable turbine rotor assembly, is configured to receive cooling air therein. A sealing feature, located on the rotatable turbine rotor assembly and extending axially into the wheel space terminates adjacent to a sealing land positioned on the second, stationary nozzle assembly. The sealing feature and the sealing land operate to control the release of the cooling air from within the wheel space. The sealing land is constructed of shape memory alloy having a composition such that a phase changes from a cold, martensitic state to a hot, austenitic state is within the heat transient of the gas turbine engine. The shape memory alloy is configured as a two-way alloy having a first configuration in the cold, martensitic state and a second configuration in the hot, austenitic state and is operable to maintain the sealing feature adjacent the sealing land during thermal expansion of the turbine rotor assembly.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which.

DETAILED DESCRIPTION OF THE INVENTION

Figure 1:
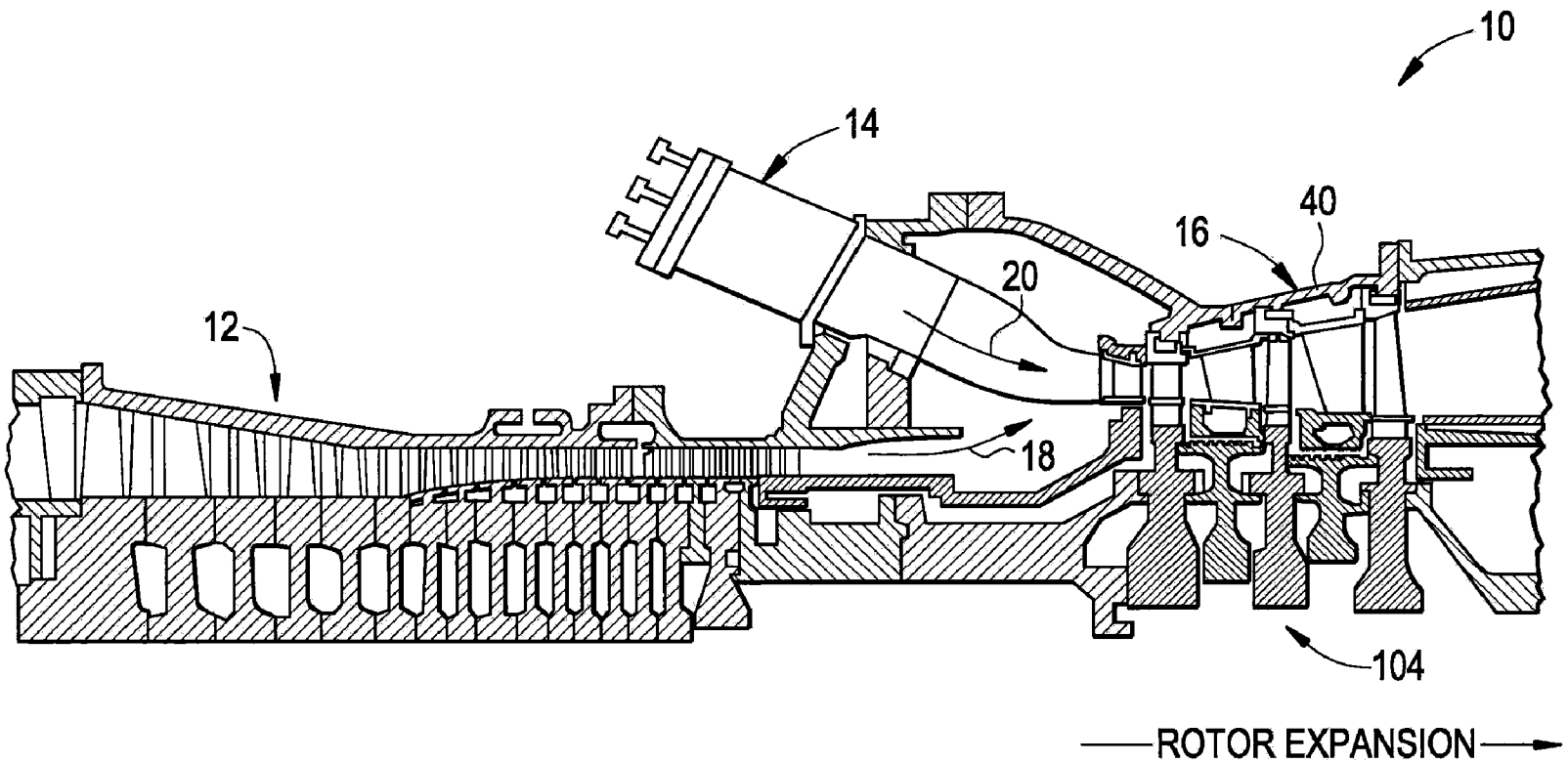
FIG. 1 is an axial sectional view through a portion of an exemplary gas turbine engine in accordance with an embodiment of the invention.
Figure 2:
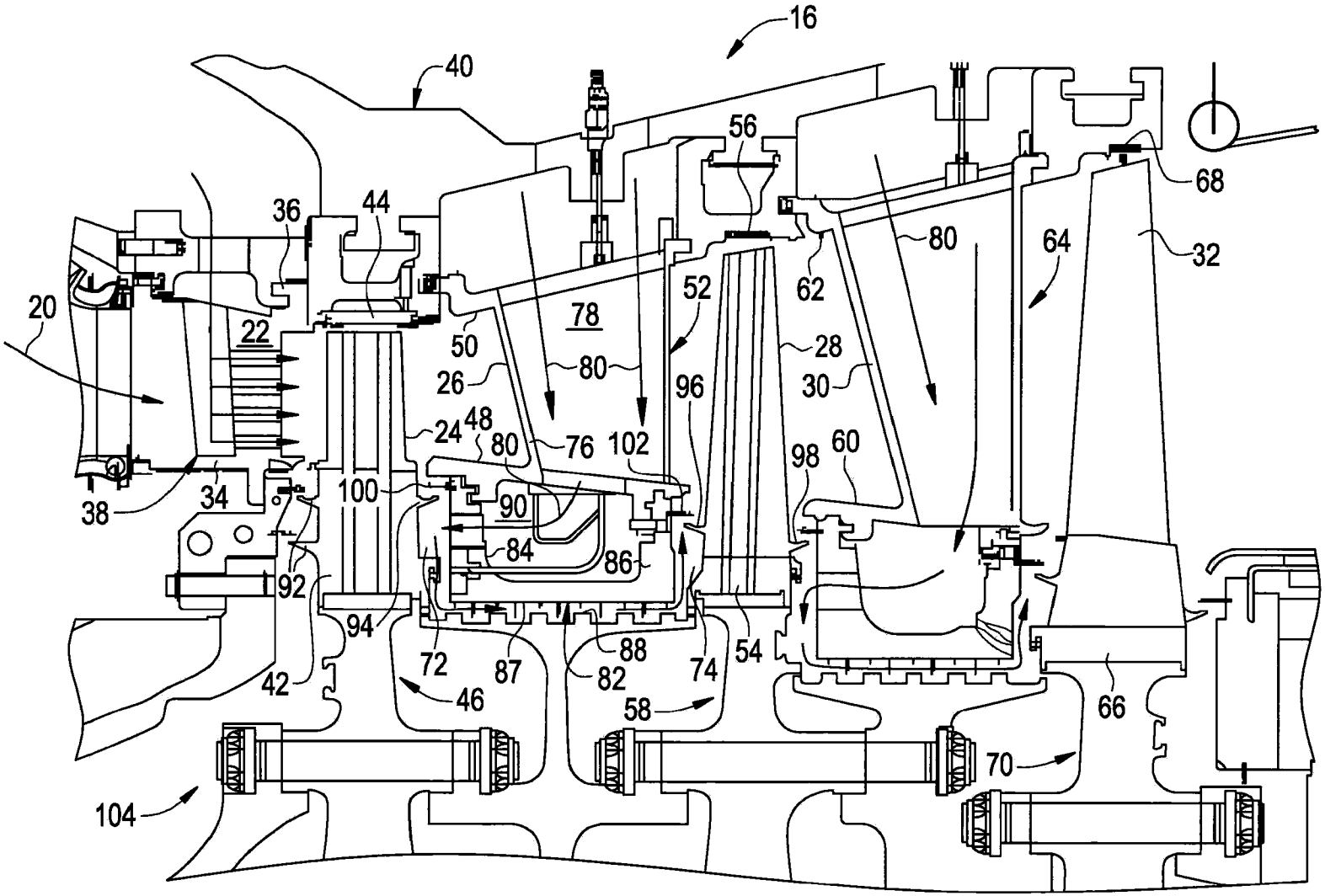
FIG. 2 is an enlarged sectional view through a portion of the gas turbine engine of FIG. 1.

Illustrated in FIGS. 1 and 2 is a portion of a gas turbine engine 10. The engine is axisymmetrical about a longitudinal, or axial centerline axis and includes, in serial flow communication, a multistage axial compressor 12, a combustor 14, and a multi-stage turbine 16.

During operation, compressed air 18 from the compressor 12 flows to the combustor 14 that operates to combust fuel with the compressed air for generating hot combustion gas 20. The hot combustion gas 20 flows downstream through the multi-stage turbine 16, which extracts energy therefrom.

As shown in FIGS. 1 and 2, an example of a multi-stage axial turbine 16 may be configured in three stages having six rows of airfoils 22, 24, 26, 28, 30, 32 disposed axially, in direct sequence with each other, for channeling the hot combustion gas 20 therethrough and, for extracting energy therefrom.

The airfoils 22 are configured as first stage nozzle vane airfoils. The airfoils are circumferentially spaced apart from each other and extend radially between inner and outer vane sidewalls 34, 36 to define first stage nozzle assembly 38. The nozzle assembly 38 is stationary within the turbine housing 40 and operates to receive and direct the hot combustion gas 20 from the combustor 14. Airfoils 24 extend radially outwardly from the perimeter of a first supporting disk 42 to terminate adjacent first stage shroud 44. The airfoils 24 and the supporting disk 42 define the first stage turbine rotor assembly 46 that receives the hot combustion gas 20 from the first stage nozzle assembly 38 to rotate the first stage turbine rotor assembly 46, thereby extracting energy from the hot combustion gas.

The airfoils 26 are configured as second stage nozzle vane airfoils. The airfoils are circumferentially spaced apart from each other and extend radially between inner and outer vane sidewalls 48 and 50 to define second stage nozzle assembly 52. The second stage nozzle assembly 52 is stationary within the turbine housing 40 and operates to receive the hot combustion gas 20 from the first stage turbine rotor assembly 46. Airfoils 28 extend radially outwardly from a second supporting disk 54 to terminate adjacent second stage shroud 56. The airfoils 28 and the supporting disk 54 define the second stage turbine rotor assembly 58 for directly receiving hot combustion gas 20 from the second stage nozzle assembly 52 for additionally extracting energy therefrom.

Similarly, the airfoils 30 are configured as third stage nozzle vane airfoils circumferentially spaced apart from each other and extending radially between inner and outer vane sidewalls 60 and 62 to define a third stage nozzle assembly 64. The third stage nozzle assembly 64 is stationary within the turbine housing 40 and operates to receive the hot combustion gas 20 from the second stage turbine rotor assembly 58. Airfoils 32 extend radially outwardly from a third supporting disk 66 to terminate adjacent third stage shroud 68. The airfoils 32 and the supporting disk 66 define the third stage turbine rotor assembly 70 for directly receiving hot combustion gas 20 from the third stage nozzle assembly 64 for additionally extracting energy therefrom. The number of stages utilized in a multistage turbine 16 may vary depending upon the particular application of the gas turbine engine 10.

As indicated, first, second and third stage nozzle assemblies 38, 52 and 64 are stationary relative to the turbine housing 40 while the turbine rotor assemblies 46, 58 and 70 are mounted for rotation therein. As such, there are defined between the stationary and rotational components, cavities that may be referred to as wheel spaces. Exemplary wheel spaces 72 and 74, illustrated in FIG. 2, reside on either side of the second stage nozzle assembly 52 between the nozzle assembly and the first stage turbine rotor assembly 46 and the nozzle assembly and the second stage rotor assembly 58.

The turbine airfoils as well as the wheel spaces 72, 74 are exposed to the hot combustion gas 20 during operation of the turbine engine 10. To assure desired durability of such internal components they are typically cooled. For example, second stage nozzle airfoils 26 are hollow with walls 76 defining a coolant passage 78. In an exemplary embodiment, a portion of compressed air from the multistage axial compressor 12 is diverted from the combustor and used as cooling air 80, which is channeled through the airfoil 26 for internal cooling. Extending radially inward of the second stage inner vane sidewall 48 is a diaphragm assembly 82. The diaphragm assembly includes radially extending side portions 84 and 86 with an inner radial end 87 closely adjacent the rotor surface 88. An inner cooling passage 90 receives a portion of the cooling air 80 passing through the airfoil coolant passage 78 and disperses the cooling air into the wheel spaces 72 and 74 to maintain acceptable temperature levels therein. Sealing features 92 and 94, referred to as "angel wings", are disposed on the upstream and downstream sides of the first stage turbine airfoils 24. Similarly, sealing features 96 and 98 are disposed on the upstream and downstream sides of the second stage turbine airfoils 28. The sealing features, or angel wings, extend in an axial direction and terminate within their associated wheel spaces closely adjacent to complementary sealing lands such as 100 and 102, mounted in and extending from radially extending side portions 84, 86 of the second stage diaphragm assembly 82. During operation of the turbine engine, leakage of cooling air 80, flowing into the wheel spaces 72 and 74 from the inner cooling passage 90 of the diaphragm assembly 82, is controlled by the close proximity of the upstream and downstream sealing features 96, 94 and the sealing lands 100, 102. Similar sealing features and sealing lands may also be used between stationary and rotating portions of the other turbine stages of the turbine engine 10.

During operation of the gas turbine engine 10, especially as the temperature of the engine transitions from a cold state to a hot state following start-up, the various components of the engine, already described above, may experience some degree of thermal expansion resulting in dimensional changes in the engine 10 which must be accounted for. For instance, as the temperature rises, the entire turbine rotor assembly 104 may expand axially relative to the fixed nozzle assemblies as well as the turbine housing 40. Due to the manner in which the turbine rotor assembly 104 is supported within the turbine housing 40, such axial expansion is primarily in the down stream direction relative to the housing, FIG. 1. As a result of the downstream relative movement, the axial over-lap spacing between the downstream sealing features 94 of first stage turbine rotor assembly 46 and the second stage upstream sealing land 100 may increase, resulting in a decrease in the leakage of cooling air 80 into the main gas stream 20 from wheel space 72. Conversely, the axial over-lap spacing between the second stage downstream sealing land 102 and the upstream sealing feature 96 of the second stage turbine rotor assembly 58 may decrease. Baring contact, the increase/decrease between sealing features is of minor consequence. However, since the cooling air 80 is diverted air from the axial compressor, its usage for purposes other than combustion will directly influence the efficiency of the gas turbine engine 10 and the designed operation of the wheel spaces. Each wheel space is designed to maintain a specific flow of cooling air to prevent the ingestion of the main gas stream 20 into the wheel space. Therefore, the decrease in axial over-lap spacing between the upstream sealing features 96 of second stage turbine rotor assembly 58 and the second stage downstream sealing land 102 is undesirable because the incorrect amount of flow is delivered to this wheel space 74. Accordingly, wheel space 74 with its decrease in axial overlap distance will leak more than the designed flow into the main gas stream 20.

Figure 3:
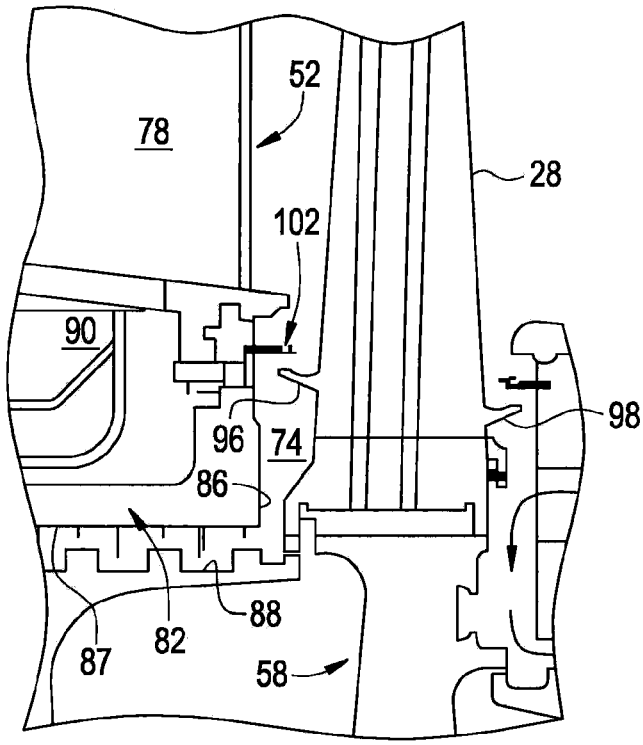
FIG. 3 is an enlarged sectional view through a portion of the gas turbine engine of FIG. 1 in a cold, non-operational state.
Figure 4:
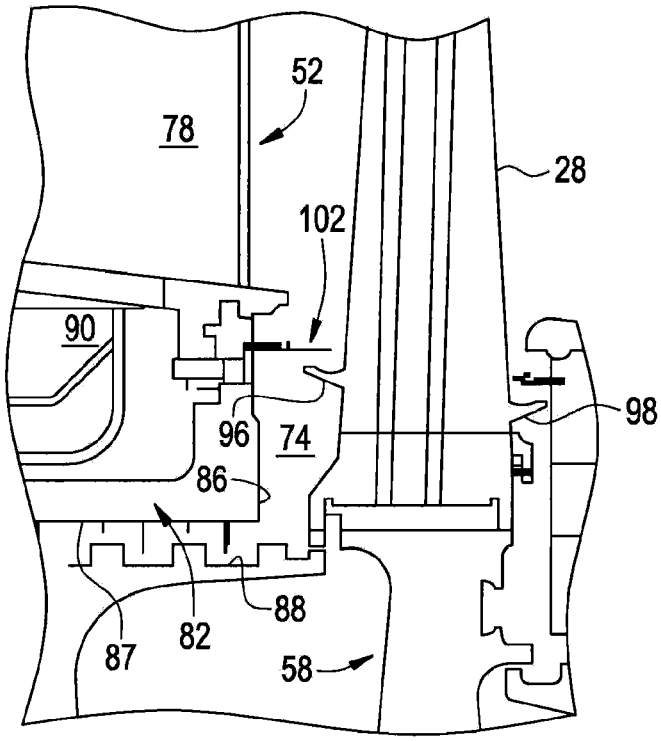
FIG. 4 is an enlarged sectional view through a portion of the gas turbine engine of FIG. 1 in a hot, operational state.

In one exemplary embodiment, the second stage downstream sealing land 102 comprises a band that is constructed of a two-way shape memory metal such as a nickel-titanium ("NiTi") alloy. Shape memory alloy can exist in two different, temperature dependant crystal structures or phases (i.e. martensite (lower temperature) and austenite (higher temperature)), with the temperature at which the phase change occurs dependant upon the composition of the alloy. Two-way shape memory alloy has the ability to recover a preset shape upon heating above the transformation temperature and to return to a certain alternate shape upon cooling below the transformation temperature. Sealing land 102 is configured using a NiTi alloy having a phase change within the heat transient of the gas turbine engine 10. Through a process of mechanical working and heat treatment, the land 102 is subject to a programming process in which the martensite configuration has an axially shorter length than the austenite configuration, which is axially longer. In some cases the martensite configuration may also be programmed to have a radially differing position relative to the radial sealing feature 96 than in the austenite configuration. As the gas turbine engine 10 transitions from cold to hot following start up, the sealing land 102 will proceed through its martensitic phase FIG. 3, to its austenitic phase FIG. 4, resulting in axial growth of the land and maintenance of the close physical spacing between the upstream sealing features 96 of second stage turbine rotor assembly 58 and the second stage downstream sealing land 102 regardless of the downstream axial growth of the turbine rotor assembly 104. The result is reduced passage of cooling air 80 from within the downstream wheel space 74 between second stage turbine rotor assembly 58 and the diaphragm assembly 82 of the second stage nozzle assembly 52, thereby improving the efficiency of the gas turbine engine and maintaining control of the wheel space cooling air flows. It is contemplated that, if desirable, the sealing land 102 may also be designed to include a radial as well as an axial change in clearance as the gas turbine engine 10 transitions from cold to hot.

In another embodiment of the invention, the second stage downstream sealing land 102 comprises a band that is constructed of a one-way shape memory metal such as a nickel-titanium ("NiTi") alloy. Like two-way shape memory alloy, one-way shape memory alloy can exist in two different, temperature dependant crystal structures or phases (i.e. martensite (lower temperature) and austenite (higher temperature), with the temperature at which the phase change occurs dependant upon the composition of the alloy. Unlike two way shape memory alloy, one way allow has the ability to recover a preset shape upon heating above the transformation temperature following its mechanical deformation in the cold, martensite state. Upon cooling, the result of the mechanical deformation is erased. Sealing land 102 is configured using a NiTi alloy having a phase change within the heat transient of the gas turbine engine 10. As the gas turbine engine 10 transitions from hot to cold following shutdown, the sealing land 102 will transition from its austenitic to its martensite state. Cooling of the turbine rotor assembly 104 results in the axial over-lap spacing between the sealing lands 102 and upstream sealing features 96 of second stage turbine rotor assembly 58 to increase. Following transition to the cold, martensitic phase the sealing land 102 may contact the sealing features 96 resulting in deformation of the sealing land. Following restart of the gas turbine engine 10 and passage of the sealing land 102 through its martensitic to austenitic phase change the second stage downstream sealing land 102 will return to its un-deformed, initial state in close physical proximity to the upstream sealing features 96 of second stage turbine rotor assembly 58. The result is reduced leakage of cooling air 80 from within the downstream wheel space 74 between second stage turbine rotor assembly 58 and the diaphragm assembly 82 of the second stage nozzle assembly 52, thereby improving the efficiency of the gas turbine engine and maintaining control of the wheel space cooling air flows.

While exemplary embodiments of the invention have been described with application primarily to a second stage of a multi-stage turbine, the focused description is for simplification only and the scope of the invention is not intended to be limited to that single application. The application of the described invention can be applied to similar turbine engine assemblies and components throughout the various stages.

While exemplary embodiments of the invention have been described with reference to shape memory alloys of a nickel-titanium composition, other compositions such as nickel-metallic cobalt, copper-zinc or others, which exhibit suitable behavior at the desired temperatures of the turbine engine, may be utilized. In addition, the above description has been made with reference to an axial growth component in the seal land. It is recognized that due to the versatility of the shape memory alloys, the sealing land 102 may include a radial as well as an axial change in clearance from cold to hot.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbine engine comprising:

a first turbine engine assembly;

a second turbine engine assembly disposed adjacent thereto;

a wheel space defined between the first turbine engine assembly and the second turbine engine assembly and configured to receive cooling air therein; and a sealing feature located on the first turbine engine assembly and extending axially into the wheel space to terminate adjacent to a sealing land positioned on the second turbine engine assembly, the sealing feature and the sealing land operable to control the release of the cooling air from within the wheel space, the sealing land constructed of shape memory alloy having a first axial length in a cold, martensitic state and a second, longer axial length in a hot, austenitic state.

2. The turbine engine of claim 1, wherein the sealing land constructed of shape memory alloy is configured of a two-way alloy.

3. The turbine engine of claim 1, wherein the sealing land constructed of shape memory alloy has a composition such that a phase change from a cold, martensitic state to a hot, austenitic state is within a heat transient of the gas turbine engine.

4. The turbine engine of claim 1, wherein the shape memory alloy comprises a nickel-titanium alloy.

5. The turbine engine of claim 1, wherein the sealing land constructed of shape memory alloy is configured of a one-way alloy having the second, longer axial length in a hot, austenitic state and is deformed by contact with the sealing feature located on the first turbine engine assembly in the cold, martensitic state and returns to the second, longer axial length following transition to the hot, austenitic state.

6. A turbine engine comprising:

a first, rotatable turbine rotor assembly;

a second, stationary nozzle assembly disposed adjacent thereto;

a wheel space defined between the first, rotatable turbine rotor assembly and the second, stationary nozzle assembly and configured to receive cooling air therein; and a sealing feature located on the first rotatable turbine rotor assembly and extending axially into the wheel space to terminate adjacent to a sealing land positioned on the second, stationary nozzle assembly, the sealing feature and the sealing land operable to control the release of the cooling air from within the wheel space, the sealing land constructed of shape memory alloy having a first axial length in a cold, martensitic state and a second, longer axial length in a hot, austenitic state.

7. The turbine engine of claim 6, wherein the sealing land constructed of shape memory alloy is configured of a two-way alloy.

8. The turbine engine of claim 6, the wherein the sealing land constructed of shape memory alloy has a composition such that a phase change from a cold, martensitic state to a hot, austenitic state is within a heat transient of the gas turbine engine.

9. The turbine engine of claim 6, wherein the sealing land constructed of shape memory alloy comprises a nickel-titanium alloy.

10. The turbine engine of claim 6, wherein the shape memory alloy is configured as a one-way alloy having the second, longer axial length in the hot, austenitic state and is deformed by contact with the sealing feature located on the first rotatable turbine rotor assembly in the cold, martensitic state and returns to the second, longer axial length following transition to the hot, austenitic state.

11. A turbine engine comprising:

a turbine housing having an upstream and a downstream end;

a stationary nozzle assembly disposed within the housing in fixed relationship thereto;

a turbine rotor assembly supported within the housing for rotation therein and operable, during operation of the turbine engine, to thermally expand in the downstream direction relative to the stationary nozzle assembly;

a wheel space defined between the stationary nozzle assembly and the rotatable turbine rotor assembly and configured to receive cooling air therein;

a sealing feature located on the rotatable turbine rotor assembly and extending axially into the wheel space to terminate adjacent to a sealing land positioned on the second, stationary nozzle assembly, the sealing feature and the sealing land operable to control the release of the cooling air from within the wheel space;

the sealing land constructed of shape memory alloy having a composition such that a phase change from a cold, martensitic state to a hot, austenitic state is within the heat transient of the gas turbine engine; and the shape memory alloy configured as a two-way alloy having a first axial length in the cold, martensitic state and a second axial length in the hot, austenitic state and operable to maintain the sealing feature adjacent the sealing land during thermal expansion of the turbine rotor assembly.

12. The turbine engine of claim 11, wherein the shape memory alloy comprises a nickel-titanium alloy.

* * * * *